United States Patent [19]

Jewitt et al.

[11] Patent Number: 4,823,973

[45] Date of Patent: Apr. 25, 1989

[54] BOTTOM SEAM FOR PAIL

[75] Inventors: Joseph H. Jewitt, Stanley; Jack Harley, Coventry, both of United Kingdom

[73] Assignee: International Paint PLC, London, England

[21] Appl. No.: 204,986

[22] Filed: Jun. 9, 1988

Related U.S. Application Data

[63] Continuation of Ser. No. 38,061, Apr. 14, 1987, abandoned.

[30] Foreign Application Priority Data

Apr. 17, 1986 [GB] United Kingdom ..... 8609459

[51] Int. Cl.[4] ..... B65D 8/00

[52] U.S. Cl. ..... 220/67; 220/69; 413/6

[58] Field of Search ..... 220/69, 67, 70, 76, 220/79, 5 R; 413/6

[56] References Cited

U.S. PATENT DOCUMENTS

| | | | |
|---|---|---|---|
| 134,379 | 12/1872 | Hemp | 220/69 |
| 300,944 | 6/1884 | Bowers | 220/70 |
| 355,495 | 1/1887 | Winstandley et al. | 220/69 |
| 782,142 | 2/1905 | Kenney | 220/67 X |
| 1,756,585 | 4/1930 | Curtis | 220/67 |
| 2,182,813 | 12/1939 | Mann et al. | 220/67 |
| 2,771,213 | 11/1956 | Lewis | 220/67 X |
| 3,108,005 | 10/1963 | Seiferth et al. | 99/171 |
| 3,698,596 | 10/1972 | Potts | 220/67 |
| 3,709,399 | 1/1973 | Nughes | 220/67 |
| 3,800,994 | 4/1974 | Bowen et al. | 220/67 X |
| 4,084,525 | 4/1978 | Booth | 220/67 X |
| 4,361,246 | 11/1982 | Nelson | 220/67 |
| 4,365,724 | 12/1982 | Walden | 220/67 |
| 4,483,456 | 11/1984 | Mays | 220/67 |
| 4,697,972 | 10/1987 | Le Bret et al. | 220/67 X |

FOREIGN PATENT DOCUMENTS

| | | |
|---|---|---|
| 3338090 | 10/1983 | Fed. Rep. of Germany . |
| 1324373 | 3/1962 | France . |
| 2140296 | 6/1971 | France . |
| 506182 | 11/1936 | United Kingdom . |
| 558436 | 7/1942 | United Kingdom . |
| 873169 | 5/1960 | United Kingdom . |
| 1317116 | 7/1971 | United Kingdom . |
| 1337169 | 12/1971 | United Kingdom . |
| 1399849 | 4/1973 | United Kingdom . |
| 1492074 | 8/1975 | United Kingdom . |
| 2067159 | 9/1980 | United Kingdom . |
| 2065593 | 12/1980 | United Kingdom . |

*Primary Examiner*—Steven M. Pollard

*Attorney, Agent, or Firm*—Davis Hoxie Faithfull & Hapgood

[57] ABSTRACT

A pail body having a longitudinal axis and an open end has an end wall fitted in the open end, said fitting involving outward bending of a flange at the open end of the pail body and interengagement of this body flange with a flange on the end wall introduced into the open end of the pail body. A region of the pail body adjacent the body flange is formed so that it is outwardly inclined with respect to the axis of the pail body at a small angle (e.g. from 4° to 12°), said angle corresponding to the angle of taper on a tapering rim part on the end wall introduced into the open end of said pail body, thus promoting close contact between said body region with said tapering rim part.

11 Claims, 2 Drawing Sheets

BOTTOM SEAM FOR PAIL

This is a continuation of co-pending application Ser. No. 038,061, filed on Apr. 14, 1987, now abandoned.

TECHNICAL FIELD

This invention relates to an end wall seam for a pail for the storage and transportation of materials and which is especially useful in the transportation of dangerous goods such as paint.

A seam according to the invention is useful for securing an irremovable end wall to a tubular pail body. The end wall may serve as the bottom end wall of a pail having a removable lid at the end intended, in normal use or storage, to be the upper end of the pail, but irremovable end walls may be seamed to both ends of a pail body. The pail is then sometimes called a "drum" and at least one of the end walls may be formed with a closable filling/emptying opening. In the present specification, the term "bottom seam" is used to denote a kind of seam used to secure an end wall (referred to generally in the description as a "bottom") irremovably to an end of a pail (which is sometimes in common usage called a "drum"). An irremovable end wall is one securely clamped to a pail body by interengagement of deformed flanges of the pail body and the end wall and which cannot, therefore, be simply levered off. Thus, the term "bottom seam" does not imply that a pail (or drum) cannot have both end walls secured by such a seam, or that such a seam or the "bottom" of the pail must necessarily be, even in the normal position of storage or use, at the lower end of the pail.

It is important in transporting materials which are corrosive or flammable that secure packages are used which are not readily susceptible to damage and leakage, for example if they are dropped during loading and unloading. Specifications for packaging have been raised over the years and it can be expected that they will be further raised.

The present invention seeks to provide a bottom seam for fastening the bottom of a pail to the pail body which is less susceptible to damage and leakage on dropping of the pail than a conventional bottom seam.

DISCUSSION OF PRIOR ART

Conventionally, a bottom seam for a pail is made by bending a flange at the lower extremity of the pail body to extend outwardly from the body at right angles. The bottom is then inserted in the pail body, a flange at the periphery of a downwardly extending rim having been formed so as to extend outwardly at right angles to the rim so that it will lie in contact with the flange on the pail body but extend beyond it. The extremity of the flange on the bottom is then bent back through 180° so that it will lie against the upper surface of the body flange. Finally, the flanges are then bent upwards through a right angle to lie close against the adjacent lower part of the pail body forming a seam in which five thicknesses of metal are compressed into contact with one another.

The present invention provides a bottom seam which is made in a manner basically similar to that described above but before the seaming operations are begun, a region of the wall of the pail body near the lower rim of the wall is formed so that it is inclined outwardly with respect to the pail body and the axis of the pail body. This enables a bottom seam to be produced which demonstrates a greater degree of integrity and resistance to damage on dropping of the pail than is shown by conventional bottom seams.

SUMMARIES OF THE INVENTION

According to one aspect of the invention a pail body adapted for fitting of at least one end wall by outward bending of a flange at an open end of the pail body and interengagement of this body flange with a flange on an end wall introduced into the open end is characterised in that a region of the pail body wall adjacent the body flange is formed so that it is outwardly inclined with respect to the longitudinal axis of the pail body at a small angle, allowing close contact between the said region and a tapering ring part on the said end wall.

The invention also extends to a method of producing a seam to secure an end wall to the open end of a pail body by outward bending of a flange at the open end of the pail body and interengagement of this body flange with a flange on the end wall introduced into the open end of the pail body which is characterised by the steps of forming an end part of the pail body wall adjacent the body flange so that a region of the pail wall is outwardly inclined with respect to the longitudinal axis of the pail body at a small angle and the flange of the pail body extends outwardly at a substantially greater angle to the said axis, inserting the end wall in the open end of the pail body so that a tapering rim part on the end wall is in close contact with the said outwardly inclined region of the pail wall and a flange on the rim part of the said end wall lies close to the flange on the pail body, and deforming the two flanges to interengage them and produce the seam.

The invention also includes a pail including a pail body as described above and a pail incorporating a bottom seam made by the method described above.

The outward inclination of the said region near the flange of the pail body allows close contact between the whole of this body region and the associated rim part of the end wall of the pail. This end wall necessarily has a slight taper to facilitate introduction of the end wall into the pail body and the invention is based on the discovery that the small gap between the inner end of the tapering rim part of the end wall and a parallel sided pail body of the prior art pails seriously affects the resistance to breakdown of the seam between the pail body and the end wall due to entry of surging liquid when a pail containing liquid is dropped onto its rim on a hard surface. By eliminating, or considerably reducing, the gap, the resistance of the associated seam to this sort of breakdown is increased.

However, if the taper on the said region of the pail body is too great, the seam between the end wall and the pail body will tend to open out when the pail is dropped onto its rim. Thus, the criteria for choosing the angle of taper (outward inclination) of the said region of the pail body are that this region is advantageously in close contact with the tapered rim part of the end wall throughout the whole of the width of the narrower of the two and above all that no gap, or virtually no gap, is left between the said region and the said part at the inner edge of the rim part. However, the taper on the pail body must not be so great that the seam between the pail body and the end part will tend to open out when a pail full of liquid is dropped on the rim concerned.

Further, there may be other factors involved in achieving a successful seam since an improvement in the strength of the seam is observed at an outward inclination of the said pail body region of 4° and it may be found even at a slightly lower angle, perhaps 3° or slightly more. It is believed that above 15° a serious tendency for the seam to "unwind" when the pail is dropped on its rim will generally be found to occur. The references to "a small angle" in the present specification are to be understood in the context of the above explanation.

BRIEF DESCRIPTION OF THE DRAWINGS

The invention will be further described, by way of example, with reference to the accompanying drawings in which.

DESCRIPTION OF PREFERRED EMBODIMENT

Figure 1:
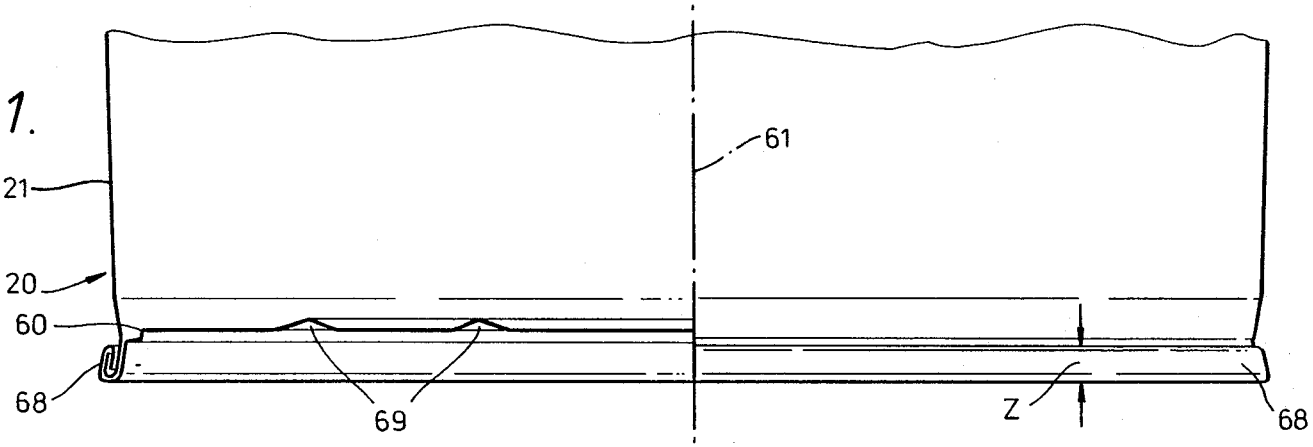
FIG. 1 is a view, partly in section of a lower part of a pail with a bottom seam according to the invention.

The pail 20 partially shown in FIG. 1 has a capacity of 20 liters and its body 21 is made from 27 gauge (0.43 mm thick) mild steel.

The first stage in manufacturing the pail body 21, in the present case, is a conventional procedure involving rolling to form a cylinder and crush welding to produce a longitudinal seam. Other welding techniques can be used to form this seam. At some stage in manufacture of the pail body, the upper rim of the body is curled ready to receive a lid, the curl and the method of fitting the lid preferably being such as to produce a head seam of a similar standard to the bottom seam to be described below.

Figure 2:
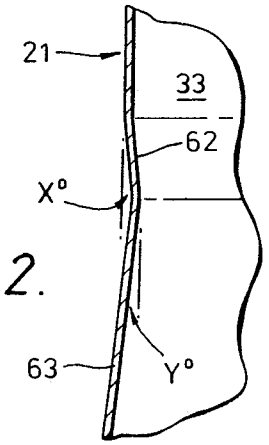
FIG. 2 is a section through part of the body of the pail shown in FIG. 1 at its lower rim at an intermediate stage of the deformation of this part to prepare the pail body for reception of a bottom.

In securing an end wall constituted by a bottom 60 to the pail body 21, the pail body is first deformed by deflecting a lower end part of the pail wall inwardly so that it lies at a small angle with the axis 61 of the pail body of from for example 8° to 15°. The region of the pail wall near its lower rim is then bent to extend outwardly with respect to the axis 61 at an angle from 4° to 15°. The result of these operations is shown in FIG. 2 where a lower end part 62 of the pail body 21 in inwardly inclined at an angle X with respect to the pail axis 61 (and thus with respect to the pail wall 33) and a region 63 of the pail wall adjacent the lower rim of the pail body 21 is outwardly inclined at an angle Y with respect to the pail axis 61 and the pail wall 33. It is preferred that X and Y are equal and in the illustrated instance X and Y are both equal to 6°.

Figure 3:
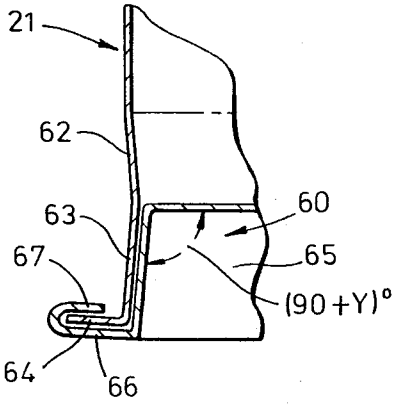
FIG. 3 is a section similar to FIG. 2 showing an intermediate stage in the fitting of the pail bottom to the pail body.

The result of the next series of operations performed in fitting the bottom 60 to the pail body 21 is shown in FIG. 3. First, the lower extremity of the pail body 21 is formed with a flange 64 consistuting the lower edge part of the region 63 of the pail body and extending outwardly at right angles or approximately at right angles to the remainder of the region 63, and thus approximately at right angles to the pail wall 33 (that is the pail body is adapted for fitting of an end wall by outward bending of the flange 64 to lie at an angle to the pail wall substantially greater than the angle Y).

The bottom 60 of the pail is initially formed so that a part 65 of its rim adjacent its periphery extends downwardly and outwardly at an angle with respect to the plane of the bottom 60 of (90+Y)°. The region 66 of the part 65 of the bottom is then bent to extend outwardly at right angles or approximately at right angles to the remainder of the part 65 and the bottom 60 is then ready for fastening to the pail body 21. To achieve this, the bottom 60 is inserted in the pail body so that the upper portion of the region 63 of the pail body 21 lies against the upper portion of the part 65 of the bottom 60 and the flange 64 of the pail body 21 rests on and is in contact with the region 66 of the bottom 60, the angular disposition of those parts being chosen to ensure this juxtaposition. Next, the outer edge part 67 of the region 66 is bent back at 180° to lie against the upper surface of the flange 64 as shown in FIG. 3 and finally the flange 64, already clamped between the outer edge part 67 and the upper part of the region 66 is bent upward to lie close against the upper parts of the region 63 of the pail body 21 and the part 65 of the bottom 60, thus producing the bottom seam 68 shown in FIG. 1 in which the flange 64 on the pail body 21 is enterengaged with a flange on the bottom 60 constituted by the region 6 of the bottom, the two flanges being deformed to achieve this interengagement. The forming operation involved in making the bottom seam 68 can be carried out using conventional types of forming machinery.

The bottom 60 is formed with two annular corrugations 69 to make it more rigid.

In the present pail, the width dimension Z of the bottom seam has been increased by 50% compared with the width of a conventional bottom seam for the same size of pail; from 4 mm to 6 mm. This, and the outward inclination of the region 63 of the pail body 21, increase the integrity of the bottom seam and reduce the deformation of the seam when the pail is dropped.

In a conventional seam it is usual to find a wedge-shaped gap between the parts equivalent to the region 63 and the part 65, but in the bottom seam described above, there is no gap, or virtually no gap, between those parts. This reduces the risk of liquid surge opening up the seam by gaining ingress between these two parts when the pail is dropped. A feature of the bottom seam described is thus that all the component parts lie flat and parallel and in close contact with one another throughout the whole or substantially the whole of their width.

The outward inclination of the region 63 and thus of the whole bottom seam encourages the seam to bend outwards when the pail is dropped onto the bottom seam, the seam thus deforming in this way but remaining intact. With a conventional seam made with a part of the pail wall parallel to the pail axis and which, after manufacture, is still parallel to the pail axis or virtually so, and if inclined outwardly is so inclined at a very small angle, perhaps 1° and certainly less that 4°, dropping the pail onto the bottom seam tends to crush the seam and cause it to leak.

It is preferred to deflect the part 62 of the pail body inwardly so that outward deflection of the region 63 will still produce a pail in which the bottom seam lies within the taper lines of the pail for stacking. However, it is not essential to incline the part 62 inwardly.

Figure 4:
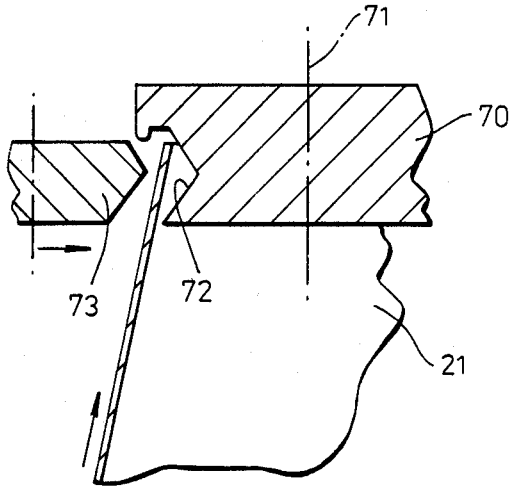
FIG. 4 is a section through part of a forming tool for preparing a pail body for the reception of a bottom.

In describing a further example of the method of the invention and of the tools used for carrying it out, reference will be made to FIGS. 4 and 5. The procedure for preparing a pail body for the reception of a bottom constituting part of the method now to be described differs from the similar procedure described above in that the deformation of the pail wall near the lower rim of the pail body is, in the present method, accomplished in a single forming operation.

The method is carried out on a forming line having conventional means for transporting pail bodies between work stations where the bodies are operated on by forming tools. The forming tool, part of which is shown in FIG. 4, comprises a cylindrical expanding chuck 7 mounted for rotation about an axis 71 and having its periphery 72 shaped to form the lower rim of a pail wall. A pail is introduced into the forming tool of FIG. 4 by a platform (not shown) on which the pail is located and which is then raised to bring the pail body 21 adjacent the periphery 72 of the chuck 70. The platform continues to urge the pail body upwards throughout the forming operation. A pair of forming wheels 73 (only one of which is shown) mounted in diametrically opposite locations with respect to the chuck 70 are then moved inwards by mounting means which are conventional in forming tools and press the region of the pail body 21 near its lower rim into the shaped periphery 72 of the chuck 70 as the chuck is rotated and expanded and thus imparts its rotation to the pail body 21.

The result is that in a single operation, the pail body 21 is deformed so that the lower end part 62 of the pail body is inwardly inclined, the region 63 of the pail wall adjacent the lower rim is outwardly inclined and the flange 64 constituting the lower edge part of the region 63 extends outwardly at right angles to the remainder of the region 63. The shape of the pail body in the area of the lower rim is thus as shown in FIG. 3.

Figure 5:
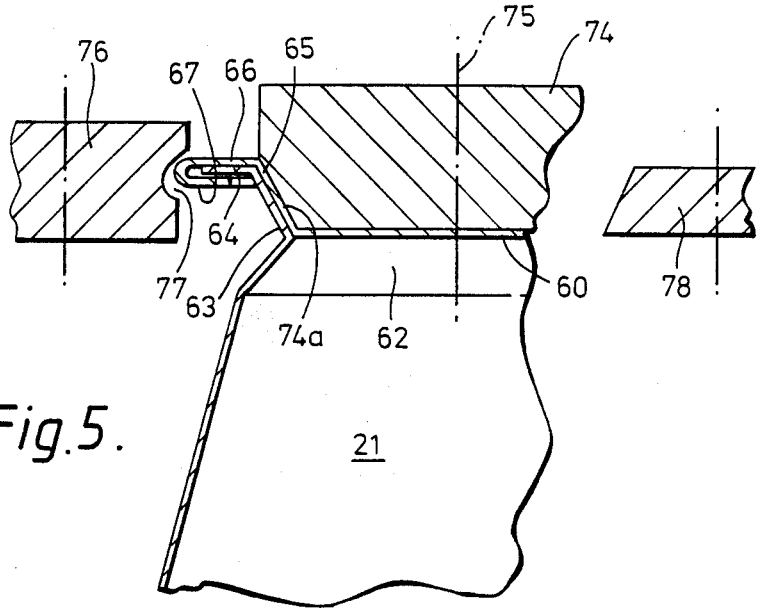
FIG. 5 is a section through part of a forming tool for fitting a pail bottom to a pail body.

One method of fitting a bottom to the pail body is illustrated in FIG. 5 showing part of a forming tool at another work station. At this work station, the pail body 21 is located on a platform (not shown) and a bottom 60 with a rim preformed to the shape shown is placed in the open end of the pail body (which is of course uppermost). The platform is then raised to bring the part 65 of the bottom into contact with a chamfer 74*a* on an expanding chuck 74 mounted for rotation about an axis 75. The chuck is next expanded and rotated carrying the bottom 60 and pail body 21 with it and a pair of forming wheels 76 (only one of which is shown) at diametrically opposed locations with respect to the chuck 74 are moved inwards to contact the region 63 of the bottom and press it in so that the part 67 curls round further and embraces the flange 64. The shape of the groove 77 in the periphery of the forming wheel 76 is such that it causes the flange 64 and the parts embracing it to bend down so as to be inclined downwardly and outwardly in FIG. 5.

At the same work station, a further pair of forming wheels 78 (only one of which is shown) at different diametrically opposite locations in relation to the chuck 74 compared with the forming wheels 76 are now moved inwards to press the flange 64 and the parts embracing it against the region 63 of the pail body 21 and flatten and complete the bottom seam.

What we claim is:

1. A metal pail suitable for storing and transporting paint and corrosive materials comprising:

a. a pail body having a longitudinal axis;

b. a pail wall having a top end and bottom end;

c. an end part of said pail wall in the direction towards the bottom end of the pail inwardly inclined to form a conical surface at a minor angle of X° with respect to said wall and said longitudinal axis;

d. a region next to said end part and further in the direction towards said bottom end of the pail, outwardly inclined to form a conical surface at a minor angle of Y° with respect to said pail wall and said longitudinal axis;

e. a first flange attached to said region;

f. an end wall, said end wall being inserted in the bottom end of the pail below said inwardly inclined end part of the pail wall;

g. a rim part of said end wall extending downwardly and outwardly at an angle with respect to the plane of the end wall, said angle being equal to (90+Y)°, said rim part being in close contact with said outwardly inclined region of said pail body so as to leave substantially no gap between said rim part and said region, the portion of said rim part remote from said end of the pail lying against the upper portion of said outwardly inclined region of said pail body; and h. a second flange on said rim part, said second flange being engaged with the first flange to seam the end wall to the pail body.

2. A metal pail according to claim 1, wherein X°=Y°.

3. A metal pail according to claim 2, wherein X° and Y° lie in the range from 4° to 12°.

4. A method of producing a seam to secure an end wall having a flange to an open end of pail body having a longitudinal axis and a pail wall, which method includes the steps of:

a. outwardly bending a flange at the open end of the pail body;

b. forming an end part of said pail wall to be conically inclined inwardly at a minor angle of X° with respect to said pail wall and said longitudinal axis;

c. forming a region of said pail wall next to said end part in the direction towards the associated end of the pail to be conically inclined outwardly at a minor angle of Y° with respect to said pail wall and said longitudinal axis;

d. forming a flange on said region of the pail body at the said end;

e. inserting an end wall into the said open end of the pail body to an axial distance from said associated end less than the distance of the inwardly inclined conical end part, said end wall having a tapering rim part extending downwardly and outwardly at an angle of (90+Y)° with respect to the plane of the end wall, and said end wall being inserted to bring said rim in close contact with the said outwardly inclined region of the pail wall to leave substantially no gap between said rim part and said region, to bring the upper portion of said region against the upper portion of said rim part, and to being the flange on said end wall close to said flange on the pail body; and f. deforming the two flanges to interengage them and produce the seam.

5. A method according to claim 4, wherein said two flanges are deformed by curling the end of the end wall flange around the pail body flange to embrace the latter and pressing the two flanges to lie against said outwardly inclined region of the pail wall.

6. A pail comprising a pail body seamed to an end wall by the method claimed in claim 5.

7. A method according to claim 4 wherein X°=Y°.

8. A pail comprising a pail body seamed to an end wall by the method claimed in claim 7.

9. A method according to claim 8, wherein X° and Y° lie in the range from 4° to 12°.

10. A pail comprising a pail body seamed to an end wall by the method claimed in claim 9.

11. A pail comprising a pail body seamed to an end wall by the method claimed in claim 4.

* * * * *